United States Patent [19]

Nedelcu

[11] Patent Number: 4,751,758

[45] Date of Patent: Jun. 21, 1988

[54] BASCULE BRIDGE ACTIVATED BY A CABLE SYSTEM

[76] Inventor: Lucian I. Nedelcu, 10 Textbook Ave., Rocky Hill, Conn. 06067

[21] Appl. No.: 888,518

[22] Filed: Jul. 23, 1986

[51] Int. Cl.[4] ..... E01D 15/06

[52] U.S. Cl. ..... 14/36

[58] Field of Search ..... 14/36–41

[56] References Cited

U.S. PATENT DOCUMENTS

| | | | |
|---|---|---|---|
| 657,122 | 9/1900 | La Pointe | 14/39 |
| 1,731,697 | 10/1929 | Allen et al. | 14/36 |
| 3,308,496 | 3/1967 | Mooney et al. | 14/36 |

FOREIGN PATENT DOCUMENTS

| | | | |
|---|---|---|---|
| 26224 | 7/1956 | Fed. Rep. of Germany | 14/36 |

*Primary Examiner*—James A. Leppink
*Assistant Examiner*—Matthew Smith

[57] ABSTRACT

The leaf bascule bridge activated by a cable system, represents a movable structure which is adapted to opened so as to permit the passage of boats or vessels through the bridge. To achieve this purpose, the bascule bridge is provided with a fixed axis on trunnions attached to the bascule bridge structure, with a cable system for driving the bascule bridge, utilizing a counterweight to counterbalance the weight of the bascule bridge structure and a safety cable to guard against the unexpected uplift of the bascule bridge due wind force. The bascule bridge is activated by a cable system using a pulling force applied to the end of the counterweight for driving the bascule bridge.

3 Claims, 1 Drawing Sheet

BASCULE BRIDGE ACTIVATED BY A CABLE SYSTEM

The present invention, is generally related to a leaf bascule bridge system and is used for driving the bascule structure by applying a pulling force at the end of the counterweight through a cable system and a safety cable for unexpected uplift of the bascule bridge structure.

BACKGROUND OF THE INVENTION

The invention relates to a method for constructing and operating a leaf bascule bridge that uses a cable system for driving the leaf bascule bridge.

Leaf bascule bridges are well known to the civil engineering professionals and their advantages are recognized by those skilled in this art.

Known methods for operating leaf bascule bridges are, either a mechanical system, or a hydraulic system; in which both methods the moving leaf rotates about a fixed axis on trunnions attached to the bascule bridge structure, and a weight at the end of the bascule structure is provided to counterbalance the weight of the cantilevered structure.

To drive the bascule bridge, a pushing force is applied to the front of the trunnions by a mechanical system mounted to the inside of the bascule pier.

The shortcomings of the existing methods are:

the driving system, either mechanical or hydraulic, is very complicated and requires qualified operators and continuous maintenance, the arm of the force applied to the leaf bascule bridge is small, requiring a large pushing force for driving the bascule bridge, the length of the bascule pier is required to be large in order to accommodate the driving mechanisms, the time required for operating a lifting cycle is lenghty, reducing the traffic capacity of the roadway.

To overcome the shortcomings of the existing methods, this invention is developed to produce a leaf bascule bridge operated by a cable system with a simplified and more efficient driving system. It utilizes a narrow bascule pier a longer span and uses a pulling force with a large arm applied to the end of the counterweight, in back of the trunnion, instead of a pushing force with a small arm applied to the front of trunnion.

SUMMARY OF THE INVENTION

The present invention represents a leaf bascule bridge using a pulling force applied to the back of trunnions. To achieve this purpose, the leaf bascule bridge is provided with a fixed axis on trunnions attached to the bascule bridge structure, with a counterweight, to counterbalance the weight of the portion of the bascule bridge structure which is cantilevered, which is attached to the back of the trunnions, with a cable system using a pulling force for driving the bascule bridge structure and with a safety cable to guard against overturning of the bascule bridge structure due to unexpected wind forces.

Another objective of this invention is to use a pulling force applied to the end of the counterweight which is attached to the back of a trunnion, having a big arm, and therefore a smaller driving force.

Another objective of this invention is to simplify the driving system of the leaf bascule bridge, in order to reduce its construction and maintenance cost.

Another objective of this invention is to reduce the dimensions of the bascule pier, thus lowering the cost of the substructure.

Another objective of this invention is to increase the span length of the leaf bascule bridge, therefore enlarging the navigable channel.

A further objective of this invention is to reduce the time cycle for driving the leaf bascule bridge.

A further objective of this invention is to increase the traffic capacity of the roadway.

A further objective of this invention is to improve the passage of boats and vessels, therefore the capacity of the waterway.

BRIEF DESCRIPTION OF THE DRAWINGS

Other objectives and advantages of the invention will become more apparent from the specifications taken in conjunction with the accompanying drawings in which.

DETAILED DESCRIPTION OF THE INVENTION

Figure 1:
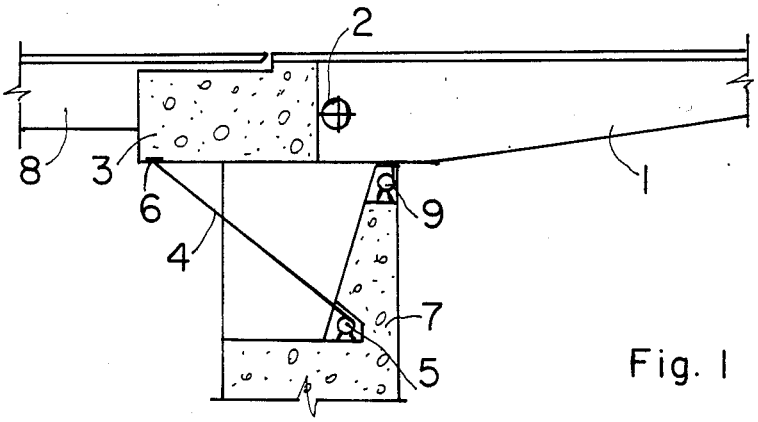
FIG. 1 represents an elevation of the leaf bascule bridge activated by a cable system in a closed position.

Referring to the drawing shown in FIG. 1, numeral 1 designates a leaf bascule structure, numeral 2 designates a pair of trunnion journal bearings, numeral 3 designates the counterweight of the bascule bridge structure made of concrete, numeral 4 designates a cable having one end attached to the counterweight through a anchor system, numeral 6, and the other end is wound on a spool activated by an electrical motor, numeral 5.

The bascule bridge structure and the cable system are supported by a bascule pier, numeral 7. The bascule bridge system is provided with a cable, numeral 9, that guards against its overturning due to the unexpected wind forces.

Figure 2:
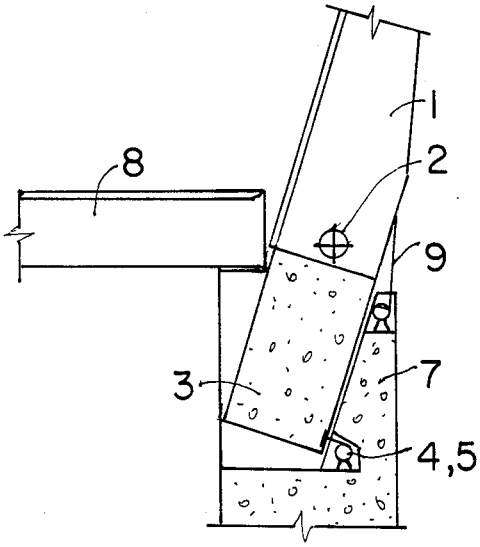
FIG. 2 represents an elevation of the leaf bascule bridge activated by a cable system in tha opened position.

Referring to the drawing shown in FIG. 2, numeral 8 designates the flanking span structure adjacent to the leaf bascule span. To activate the leaf bascule bridge, the driving cable, numeral 4, is wound on the spool, numeral 5, that is activated by an electrical motor which delivers the required torque to pull down the counterweight, numeral 3; concomitant with the uplift of the bascule bridge, the safety cable, numeral 9, which is provided with a brake mechanism activated when a unexpected uplift occurs, is released.

Figure 3:
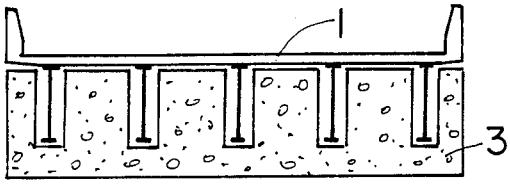
FIG. 3 represents an end view of the flanking span structure in the counterweight portion.

Referring to the drawing in FIG. 3, numeral 8 designates the flanking span structure adjacent to the leaf bascule span, in the zone of the counterweight.

Figure 4:
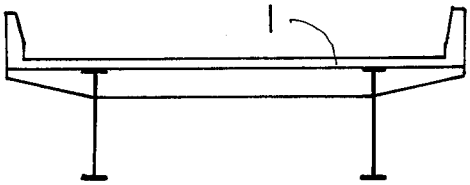
FIG. 4 represents an end view of the bascule bridge activated by a cable system in the cantilever portion of the structure.

Referring to the drawing in FIG. 4, numeral 1 designates the leaf bascule structure in its cantilevered zone.

It is obvious that the invention is not limited exclusively to the embodiments illustrated and that many modifications can be made in the form, the disposition and the nature of some of the elements used in carrying the invention into effect, provided that these modifications do not conflict with the material contained in each of the following claims.

What I claim is:

1. A leaf bascule bridge activated by a cable system, comprising a cantilever structure extended over the navigable channel, which rotates about a fixed axis on trunnions attached rigidly to said structure, with said trunnions bearing on the top of a relatively narrow bascule pier made of concrete, a counterweight at one end of said cantilever structure behind said trunnions, a driving cable attached to one end of said counterweight for operating said bascule bridge, and a safety cable attached in front of said trunnions.

2. A leaf bascule bridge activated by a cable system as described in claim 1, having the said driving cable anchored at one end at the back of the said counterweight, and at the other end wounded on a spool activated by an electrical motor which delivers the required torque to pull down the said counterweight, with said spool and said electrical motor mounted on said bascule pier, in front of the said trunnions.

3. A leaf bascule bridge activated by a cable system as described in claim 1, having said safety cable fixed at one end on the said cantilever structure, in front of the said trunnions, and at the other end wounded on a spool, having said spool equipped with a braking mechanism and mounted on said bascule pier.

* * * * *